US006953117B2

(12) United States Patent
Schein et al.

(10) Patent No.: US 6,953,117 B2
(45) Date of Patent: Oct. 11, 2005

(54) SALES PACKAGING FOR ELECTRIC STORAGE BATTERIES

(75) Inventors: Herbert Schein, Munningen (DE); Torsten Schmerer, Alsfeld (DE); Asela Jayampathy, Dallas, TX (US); Helmut Hewelt, Ellwangen (DE); Heinrich Stelzig, Rosenberg (DE); Kuno Gross, Adelmannsfelden (DE)

(73) Assignee: Varta Microbattery GmbH (DE)

( * ) Notice: Subject to any disclaimer, the term of this patent is extended or adjusted under 35 U.S.C. 154(b) by 36 days.

(21) Appl. No.: 10/388,309

(22) Filed: Mar. 13, 2003

(65) Prior Publication Data

US 2003/0205500 A1 Nov. 6, 2003

(30) Foreign Application Priority Data

May 2, 2002 (DE) ..... 102 19 421

(51) Int. Cl.[7] ..... B65D 85/88; B65D 73/00
(52) U.S. Cl. ..... 206/705; 206/461
(58) Field of Search ..... 206/703, 705, 206/461–462, 419–420

(56) References Cited

U.S. PATENT DOCUMENTS

| | | | | | |
|---|---|---|---|---|---|
| 1,066,280 | A | * | 7/1913 | Kaempfer | 206/705 |
| 1,240,239 | A | * | 9/1917 | Moffett | 429/163 |
| 1,465,627 | A | * | 8/1923 | Fisher et al. | 312/31 |
| 3,703,234 | A | | 11/1972 | Knechtel et al. | |
| 3,990,578 | A | * | 11/1976 | Roeser | 206/461 |
| 5,379,894 | A | * | 1/1995 | Haas et al. | 206/705 |
| 6,349,830 | B1 | | 2/2002 | Lebron | |

FOREIGN PATENT DOCUMENTS

| | | |
|---|---|---|
| DE | 198 57 621 | 6/2000 |

* cited by examiner

*Primary Examiner*—Bryon P. Gehman
(74) *Attorney, Agent, or Firm*—DLA Piper Rudnick Gray Cary USA LLP

(57) ABSTRACT

A sales packaging for electric storage batteries having a backing and a cover fastened thereto. The storage battery has a connecting cable and a connector. The cover encloses the storage battery. The connecting cable and connector are brought out of the sales packaging and are accessible without damaging the cover. The connector is arranged in an opening in the backing, removable therefrom, and the opening is surrounded by slits.

8 Claims, 1 Drawing Sheet

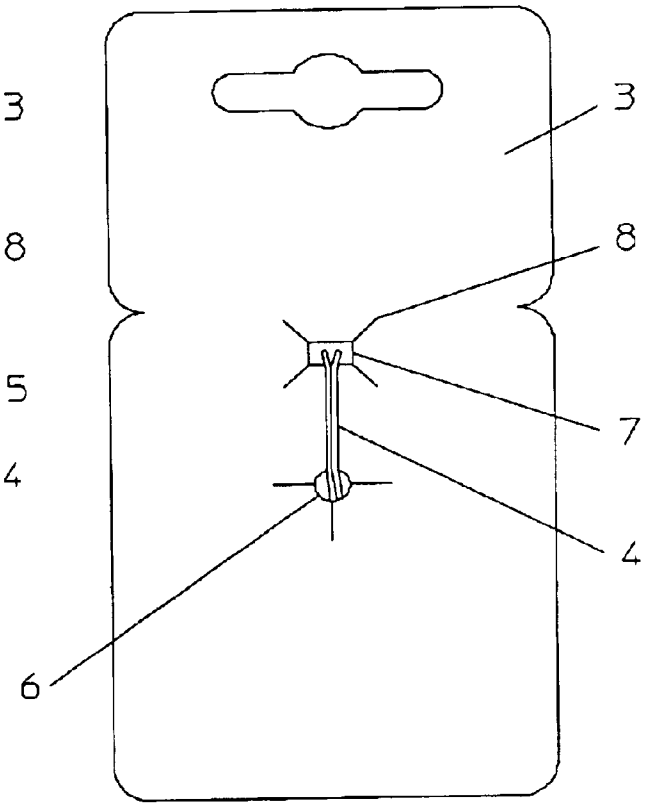
Figur 2
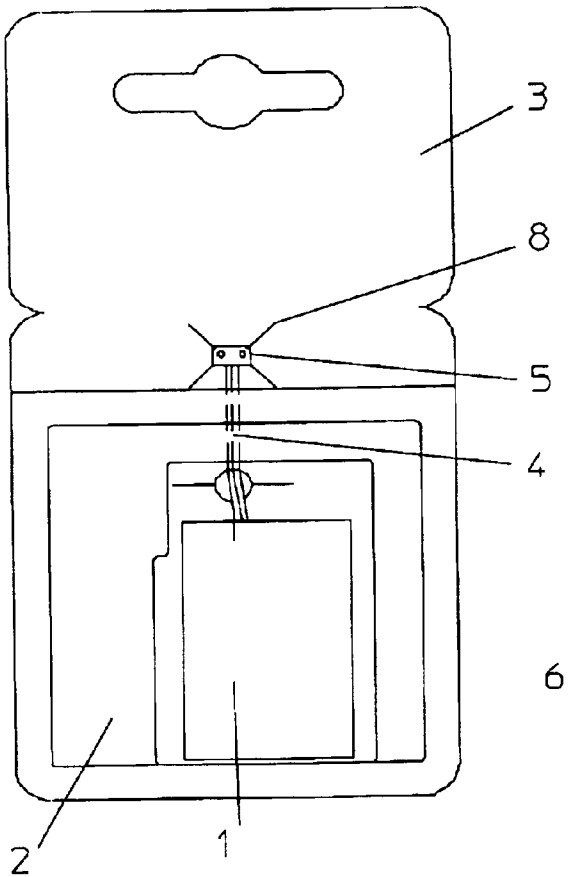
Figur 1
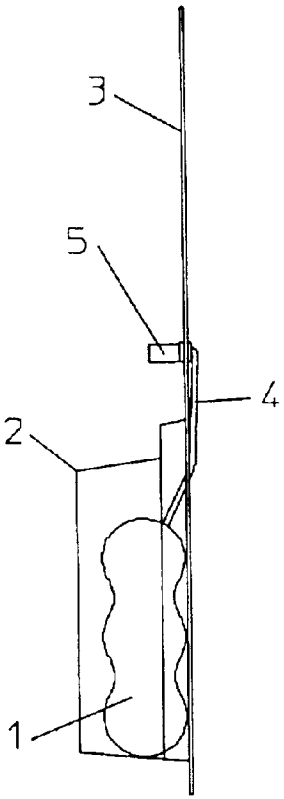
Figur 3

SALES PACKAGING FOR ELECTRIC STORAGE BATTERIES

RELATED APPLICATION

This application claims priority of German Patent Application No. DE 102 19 421.1, filed May 2, 2002.

FIELD OF THE INVENTION

The invention relates to a sales packaging for electric storage batteries that has a backing and a cover that encloses the storage battery and is fastened to that backing. The storage battery has a connecting cable and a connector.

BACKGROUND

There are a large number of manufacturers engaged in the rapidly growing market for cordless telephones and a large number of models whose batteries are equipped with a wide variety of differing, but rather similar, connectors.

Batteries of this type are generally supplied and sold in packagings consisting of a cardboard backing having a cover fabricated from a transparent plastic material that is fastened, in particular, cemented, thereto. The plastic cover encloses the storage battery, complete with its connecting cable and connector.

In the case of these known sales packagings, the battery, including its connecting cable and connector, is inaccessibly enclosed within the plastic cover or blister-pack housing. Selecting the right battery with the right mating connector thus presents problems, particularly in discount stores, since these packagings preclude making direct comparisons of connectors without opening them. Specialist personnel with the necessary knowledge are very rarely available for consultation at such stores.

Some of these packagings display merely illustrations that point out the polarity problem. These illustrations represent an effort to provide a solution to the problem.

Also known is an embodiment of such a sales packaging wherein the profile of the connector is provided in the form of an opening punched into the packagings' backing. With the old battery and its connector, one may then check whether the connectors are the same by attempting to insert the old battery's connector into the punched opening and seeing if it will fit without forcing it. However, it has been found that the punched opening will already have become so severely damaged on the first attempt that this method of checking will be unusable on the next attempt, and thus of no use to the next potential customer, and the blister-pack will thus have been destroyed.

It would therefore be advantageous to create a sales packaging for such storage batteries that will allow end users to verify the compatibility of the battery therein with the device in question.

SUMMARY OF THE INVENTION

This invention relates to a sales packaging for electric storage batteries having a connecting cable and a connector including a backing and a cover fastened to the backing such that the backing and the cover enclose the storage batteries, wherein the backing is arranged such that the connecting cable and connector are accessible without damaging the cover and/or the backing.

BRIEF DESCRIPTION OF THE DRAWINGS

The invention will be discussed in detail below, based on the figures in which:

FIG. 1 depicts a top view of a sales packaging according to aspects of the invention, FIG. 2 depicts a rear view of the sales packaging of FIG. 1, and FIG. 3 depicts a sectioned view of the sales packaging of FIG. 1.

DETAILED DESCRIPTION

It will be appreciated that the following description is intended to refer to specific embodiments of the invention selected for illustration in the drawings and is not intended to define or limit the invention, other than in the appended claims.

In the sales packaging according to the invention, the connecting cable, complete with its connector, is brought out of the cover and the connector is accessible without destroying the packaging. The connector may be arranged in an opening in the packagings' backing and capable of being removed therefrom. In addition to their visual selection of the connector, end users may thus also remove the connector and check whether it actually fits the device in question, in particular, a telephone, without need for opening the packaging, and thereby destroying it.

Simultaneously, the buyer may verify that the battery is in proper working order. If an exchange should, nevertheless, become necessary, the undamaged packaging may be readily returned to normal displayed stock.

Turning to the drawings, the storage battery 1 is arranged in a packaging consisting of a plastic cover 2 and a cardboard backing 3, where the battery's connecting cable 4, complete with its connector 5, is, in accordance with the invention, brought out through an opening 6 in the cardboard backing 3. The connector 5 is inserted into an opening 7 in the cardboard backing 3 and held in place there. The cardboard backing 3 may be slit in the vicinity of that opening 7 so that the connector 5 will thereby be clamped and held in place there. Connectors having various profiles may be clamped and held in place in an opening 7 of the type that is surrounded by slits 8.

If the old battery is available, it may be compared to various models of batteries on display and the correct battery selected. The old battery's voltage may be compared to statements appearing on the new battery's visible label and a battery with the right voltage, and thus the right model of battery, selected. Finally, the connector 5 may be withdrawn from the blister-pack's cardboard backing and checked for compatibility with that on the old battery in detail.

The connector 5, which has been made accessible in this manner, may be directly compared to the connector on the old battery and connected to the device in question, if necessary, which will allow checking the new battery for proper operation.

What is claimed is:

1. A product comprising:

a battery pack having at least one battery;

a connecting cable extending from the battery pack;

a connector attached to the connecting cable;

a cover sized and shaped to receive the battery pack; and a backing fixed to the cover, the backing having an upper opening positioned above the cover through which a portion of the connecting cable extends in a direction opposed to a direction through which the connecting cable extends through a lower opening to provide access to the connector without damaging the cover or the backing.

2. The product according to claim 1, wherein the lower opening is surrounded by slits in the backing.

3. A sales packaging for electric storage batteries including at least one storage battery having a connecting cable and a connector comprising:

a backing and a cover fastened to the backing such that the backing and the cover enclose the storage batteries, wherein the backing and the cover are configured such that at least a portion of the connecting cable with the connector may be brought out of the packaging and the connector is accessible without damaging the cover or the backing, wherein the backing has a lower opening through which the connecting cable extends, thereby providing access to the connector, and an upper opening positioned above the cover through which the connecting cable extends in a direction opposed to a direction through which the connecting cable extends through the lower opening.

4. The sales packaging according to claim 3, wherein the lower opening is surrounded by slits in the backing.

5. The sales packaging according to claim 3, wherein the connecter is arranged in the upper opening in the backing and may be removed therefrom.

6. A product comprising:

a battery pack having at least one battery;

a connecting cable extending from the battery pack;

a connector attached to the connecting cable;

a cover sized and shaped to receive the battery pack; and a backing fixed to the cover such that the backing and the cover enclose the storage batteries, wherein the backing and the cover are configured such that at least a portion of the connecting cable with the connector may be brought out of the packaging and the connector is accessible without damaging the cover or the backing and wherein the backing has a lower opening through which the connecting cable extends, thereby providing access to the connector, and an upper opening positioned above the cover through which the connecting cable extends in a direction opposed to a direction through which the connecting cable extends through the lower opening.

7. The product according to claim 6, wherein the lower opening is surrounded by slits in the backing.

8. The product according to claim 6, wherein the connecter is arranged in the upper opening in the backing and may be removed therefrom.

* * * * *